US010507570B2

(12) United States Patent
Ueda

(10) Patent No.: US 10,507,570 B2
(45) Date of Patent: Dec. 17, 2019

(54) POWER TOOL

(71) Applicant: MAKITA CORPORATION, Anjo-shi (JP)

(72) Inventor: Keigo Ueda, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 282 days.

(21) Appl. No.: 15/527,452

(22) PCT Filed: Dec. 11, 2015

(86) PCT No.: PCT/JP2015/084735
§ 371 (c)(1),
(2) Date: May 17, 2017

(87) PCT Pub. No.: WO2016/098687
PCT Pub. Date: Jun. 23, 2016

(65) Prior Publication Data

US 2017/0326719 A1 Nov. 16, 2017

(30) Foreign Application Priority Data

Dec. 15, 2014 (JP) ..... 2014-252790

(51) Int. Cl.
*B25F 5/02* (2006.01)
*B25D 17/26* (2006.01)

(52) U.S. Cl.
CPC ..... *B25F 5/02* (2013.01); *B25D 17/26* (2013.01); *B25D 2250/121* (2013.01); *B25D 2250/185* (2013.01); *B25D 2250/365* (2013.01)

(58) Field of Classification Search
CPC .. B25D 17/26; B25D 17/32; B25D 2250/185; B25D 2250/121; B25D 2250/365;
(Continued)

(56) References Cited

U.S. PATENT DOCUMENTS 4,977,799 A * 12/1990 Yasutomi ..... B25B 23/103 81/53.2
6,740,064 B1 * 5/2004 Sorrentino ..... A61L 29/06 604/264

(Continued)

FOREIGN PATENT DOCUMENTS

JP H11108053 A 4/1999
JP 2008223789 A 9/2008

(Continued)

OTHER PUBLICATIONS

Office Action from the Chinese Patent Office dated Nov. 23, 2017 in related Chinese application No. 201590001194.5, and translation of substantive portions thereof.

(Continued)

*Primary Examiner* — Scott A Smith
(74) *Attorney, Agent, or Firm* — J-Tek Law PLLC; Jeffrey D. Tekanic; Scott T. Wakeman

(57) ABSTRACT

A power tool contains one or more moving parts coated with a lubricant to reduce friction. The lubricant is intended to be sealed within a housing of the power tool. In order to better prevent leakage of the lubricant to the exterior of the housing, the housing and/or a component supported by the housing includes a part exhibiting oil repellency. The oil repellency is preferably imparted at least at a junction of the housing and the component supported by the housing. The oil repellency may be imparted by applying a fluorine-based coating or a nanocoating to the junction. In addition or in the alternative, the oil repellency may be imparted by forming a portion or all of the housing from a resin material containing an oil-repelling component and/or by attaching an oil-repellant component at or proximal to the junction.

17 Claims, 3 Drawing Sheets

(58) Field of Classification Search
CPC .. H01M 2/0262; H01M 2/029; H01M 2/0277; H01M 10/287; H02K 5/16; H02K 7/08; B27F 5/02; B25B 21/02; B25B 23/103; F16C 17/02; F16C 17/04; F16C 33/14
USPC ..... 173/109, 216, 217, 128, 171, 201, 173/DIG. 3; 429/199, 231.6, 231.95
See application file for complete search history.

(56) References Cited

U.S. PATENT DOCUMENTS

| | | | | |
|---|---|---|---|---|
| 6,852,266 | B2 * | 2/2005 | Robinson | B06B 3/02 264/338 |
| 7,273,504 | B2 * | 9/2007 | Nagai | H01M 2/0262 29/623.5 |
| 8,034,866 | B2 * | 10/2011 | Zhu | C08L 67/02 524/423 |
| 8,067,075 | B2 * | 11/2011 | Nishioka | B32B 1/08 428/36.91 |
| 8,210,277 | B2 | 7/2012 | Umeda et al. | |
| 8,388,232 | B2 * | 3/2013 | Iida | F16C 27/066 277/574 |
| 8,522,890 | B2 * | 9/2013 | Abe | B25D 17/26 173/216 |
| 2006/0097592 | A1 | 5/2006 | Sumi | |
| 2009/0107691 | A1 | 4/2009 | Umeda et al. | |
| 2010/0102104 | A1 * | 4/2010 | Tanimoto | B25C 1/06 227/146 |
| 2011/0155402 | A1 | 6/2011 | Abe et al. | |

FOREIGN PATENT DOCUMENTS

| | | | |
|---|---|---|---|
| JP | 2008304016 | A | 12/2008 |
| JP | 2009174685 | A | 8/2009 |
| JP | 2010019322 | A | 1/2010 |
| JP | 2010190426 | A | 9/2010 |
| JP | 2011085182 | A | 4/2011 |
| JP | 2011131358 | A | 7/2011 |
| JP | 5073449 | B2 | 8/2012 |
| JP | 2014100760 | A | 6/2014 |

OTHER PUBLICATIONS

English translation of International Search Report dated Feb. 16, 2016 for parent application No. PCT/JP2015/084735.
English translation of Written Opinion of the International Searching Authority for parent application No. PCT/JP2015/084735.
Office Action from the Japanese Patent Office dated Jul. 31, 2018 in related Japanese application No. 2014-252790, and machine translation thereof.

* cited by examiner

POWER TOOL

CROSS-REFERENCE

This application is the U.S. National Stage of International Application No. PCT/JP2015/084735 filed on Dec. 11, 2015, which claims priority to Japanese patent application no. 2014-252790 filed on Dec. 15, 2014.

TECHNICAL FIELD

The present invention relates to a power tool such as, for example, a hammer drill.

BACKGROUND ART

A reduction gear train is disposed within a power tool, such as the above-mentioned hammer drill, for reducing the rotational output speed of an electric motor that serves as a drive source. The reduction gear train is housed inside a gear housing. A lubricant such as grease is coated on the reduction gear train. Because lubricant-coated parts hold heat that is caused by operation of the power tool, the viscosity of the coated lubricant decreases or it liquefies; because the lubricant is pressurized by agitation, the lubricant tends to leak to the exterior through small gaps between joining surfaces of the gear housing.

Typically, an oil seal, a gasket, or the like is interposed between the joining surfaces of the gear housing to prevent leakage of the lubricant; in addition, a technique for preventing oil leakage without using a separate component such as an oil seal is disclosed in a patent document (Japanese Patent No. 5073449). In this patent document, a technique for preventing lubricant from going through small gaps owing to capillary action and from leaking to the exterior of the housing is disclosed.

SUMMARY OF THE INVENTION

Nevertheless, in the above-mentioned, known lubricant-leakage-prevention structure that deters leakage of lubricant to the exterior by interrupting or blocking the capillary action, there is a risk that leakage cannot be reliably prevented in case a large amount of lubricant enters into a gap between the joining surfaces of the housing or the like. An object of the present teachings is to further enhance the sealing properties of a housing, a chamber, or the like that houses lubricant-coated parts, such as a gear train or the like, that are coated with lubricant.

In a first invention of the present teachings, a power tool comprises a lubricant-coated part coated with a lubricant. Oil repellency (a surface property of a material that causes the lubricant to form droplets) for preventing leakage of the lubricant to the exterior of a housing is imparted to the housing, which houses the lubricant-coated part, and/or to a component supported by the housing.

According to the first invention, oil repellency is imparted to a part (a vital seal part), which is the housing or a component supported by the housing where leakage of the lubricant is expected due to the presence of a small gap. Owing to the oil repellency, the lubricant (grease, oil, or the like) is caused to form droplets at the vital seal part, and thereby leakage (diffusion) of the lubricant to the exterior via the small gap at the vital seal part of the housing is prevented. Therefore, according to the first invention, the sealing properties of the housing can be reliably enhanced more than a configuration that prevents leakage by interrupting capillary action as in the past. In addition, because the sealing properties of the lubricant-coated parts can be ensured without separately using a sealing element, such as an O-ring, costs can be reduced and assembly can be simplified by omitting the sealing element.

The junction between the housing and another housing joined to that housing and the junction between the housing or the other housing and the component joined thereto or held thereby serve as the part(s) (the vital seal part(s)) at which leakage of the lubricant is expected. The housing and the component held by the other housing include a sealing element, such as, for example, a bearing, an oil seal, or an O-ring, and in addition include various shaft components (e.g., a motor-output shaft) supported by the bearing. Oil repellency is imparted to an inner circumferential surface of a holding hole, an outer circumferential surface of a bearing, a sealing element, or the like, which are junctions that join the bearing, the sealing element, and the like to the housing or the other housing. In addition, oil repellency can also be imparted to the bearing, the sealing element, and the shaft component supported on the inner-circumference side thereof. In this case, oil repellency can be imparted to the inner circumferential surface and to both side surfaces of an inner ring of the bearing, or to a lip part and to both side surfaces on the inner-circumference side of the oil seal. In addition, leakage of the lubricant can be prevented much more reliably by also imparting oil repellency to the outer circumferential surface of the shaft component that is contacted by an inner circumferential surface of the bearing inner ring or is slidably contacted by the lip part of the oil seal and to a peripheral area thereof.

In the first invention, in addition to electric power tools, such as the above-mentioned hammer drill, electric circular saws, or the like, examples of power tools also include air compressors, tillers, cultivators, or the like; further, it can be broadly applied to power tools that comprise various types of housings that house (a) component(s) coated with a lubricant.

In a power tool, such as, for example, a hammer drill, an electric circular saw, or the like, a gear housing, which houses a reduction gear train for reducing the rotational output speed of an electric motor, corresponds to the housing. Owing to the operation of the power tool, the temperature of the lubricant increases, viscosity decreases, and thereby the lubricant liquefies. When lubricant whose viscosity has decreased or that has liquefied reaches a vital seal part of the gear housing (a part that is supported by the other component and at which a small gap exists), the lubricant is caused to form droplets owing to the oil repellency of the vital seal part. By virtue of the lubricant being caused to form droplets, diffusion of the lubricant is deterred and leakage to the exterior through the small gap of the vital seal part is prevented.

In addition, the housing can include an air-storage tank of an air compressor for generating compressed air that includes lubricant or an oil chamber in an engine of a tiller, a cultivator, or the like. In this type of housing, a cover or another housing that closes up an opening of the housing, or some other component such as a bearing that rotationally supports a gear or the like, is supported by (coupled to) the housing. The lubricant-coated part(s) correspond(s) to a part—principally a reduction gear train, a part that supports sliding in an axial direction or about an axis, or the like—coated with a lubricant, such as ordinary grease, for the purpose of reducing frictional resistance and the like.

The second invention is the power tool according to the first invention, wherein the oil repellency is imparted at a junction of the housing and the component supported by the housing.

According to the second invention, leakage of the lubricant can be prevented most efficiently. In addition to the joining surface, an inner surface of the housing, which is upstream of the joining surface in the leakage direction, can also serve as a part that is imparted with oil repellency.

The third invention is the power tool according to the second invention, wherein the oil repellency is imparted by applying a fluorine-based coating to the junction.

According to the third invention, leakage of the lubricant can be prevented with good efficiency without complicating the configuration and without adding a separate component.

The fourth invention is the power tool according to the second invention, wherein the oil repellency is imparted by applying a nanocoating to the junction.

According to the fourth invention, leakage of the lubricant can be prevented with good efficiency without complicating the configuration and without adding a separate component.

The fifth invention is the power tool according to the first invention, wherein the oil repellency is imparted at a sliding-contact part of a component that slidably supports the component supported by the housing or the housing.

According to the fifth invention, by imparting oil repellency not only to the junction of the housing that houses the lubricant-coated part(s) mentioned above, but also to the sliding-contact part coated with the lubricant, the sealing properties at the sliding-contact part can be enhanced. According to the fifth invention, the lubricant can be prevented from flowing out to the exterior of the housing via the sliding-contact part owing to the lubricant being caused to form droplets. In addition, by imparting oil repellency to the sliding-contact part, diffusion of the lubricant, with which the sliding-contact part is coated, is prevented, and thereby a high slidability of the sliding-contact part can be maintained over a long time.

The sixth invention is the power tool according to any one of the first to fifth inventions, wherein the housing is formed such that a resin that contains an oil-repellent component serves as a raw material.

According to the sixth invention, because the entirety of the housing or of the component supported by the housing exhibits oil repellency, the sealing properties of the housing or of the component supported by the housing can be enhanced much more greatly. In addition, in the process of manufacturing the housing or the component supported by the housing, a process that imparts oil repellency can be omitted.

The seventh invention is the power tool according to any one of the first to fifth inventions, wherein the oil repellency is imparted by attaching an oil-repellent component exhibiting oil repellency.

According to the seventh invention, the sealing properties of a vital seal part can be enhanced by attaching an oil-repellent component. Because the sealing properties can be enhanced by retrofitting a vital seal part with an oil-repellent component, it is possible to greatly expand the applicable scope of the seventh invention.

DETAILED DESCRIPTION

Figure 1:
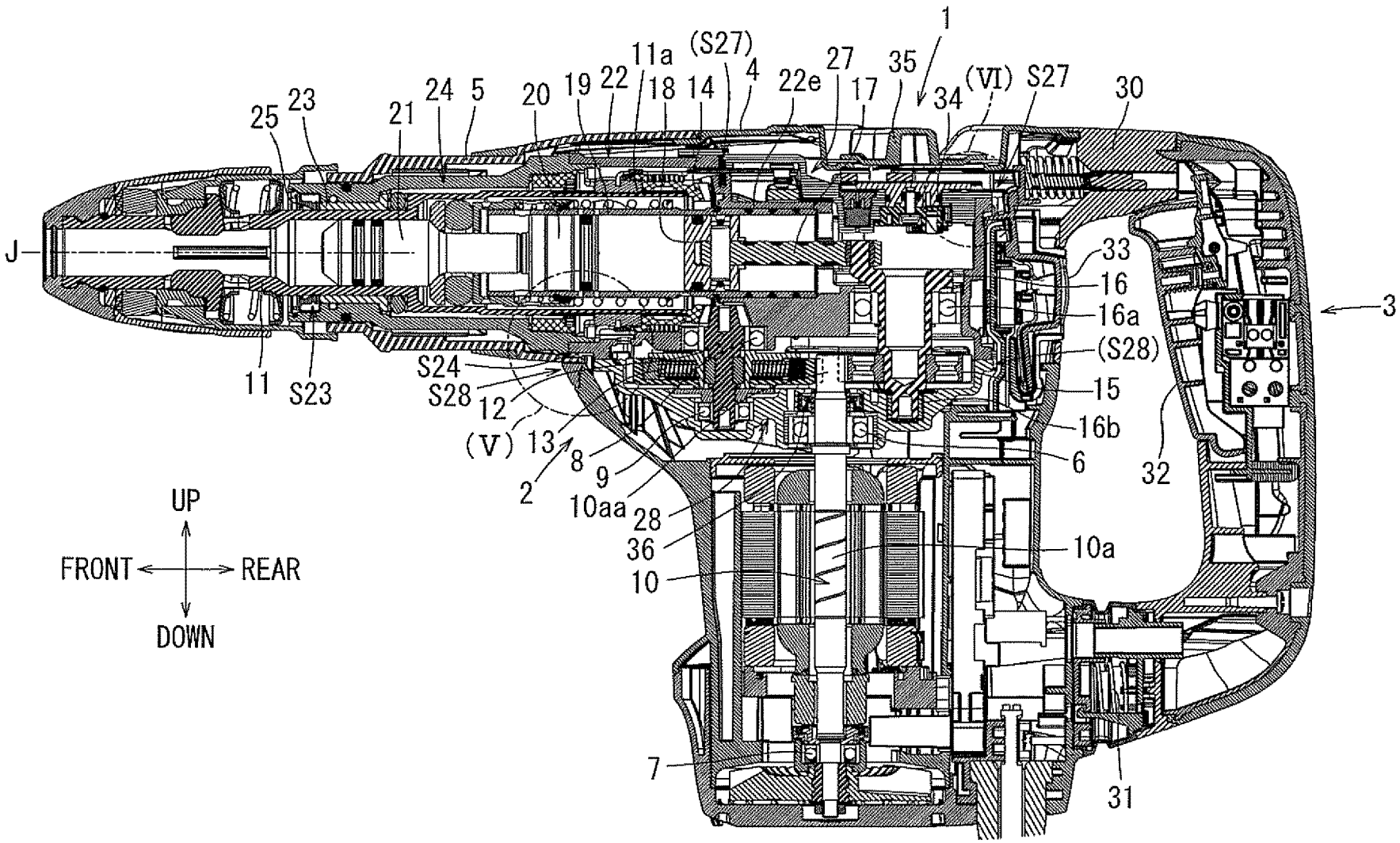
FIG. 1 is a longitudinal-cross-sectional view of the entirety of a power tool according to an embodiment of the present invention.

An embodiment of the present invention will be explained below based on FIG. 1 to FIG. 6. As shown in FIG. 1, in the present embodiment, a hammer drill is illustrated as an example of a power tool 1. Because the present embodiment features a configuration for preventing oil leakage of a lubricant-coated part, a modification is not particularly required with respect to the basic configuration of the power tool 1. The basic configuration of the power tool 1 is briefly explained below.

The power tool 1 comprises a main-body part 2, in which an electric motor 10 that serves as a drive source is disposed therein, and a D-shaped handle 3, which is grasped by a user. The handle 3 is coupled to a rear part of a main-body housing 4 via vibration-absorbers 30, 31 at two, upper and lower, locations. A trigger-type switch lever 32 is provided on an inner-circumference side of the handle 3. A pushbutton 33 is provided, opposing the switch lever 32, on a rear surface of the main-body part 2. Furthermore, a mode-changing lever 35 is provided on an upper surface of the main-body part 2. By switching the mode-changing lever 35, the startup and stop operations of the main-body part 2 can be switched to "trigger-switch mode" or "pushbutton mode". In the "trigger-switch mode", the electric motor 10 starts up when the switch lever 32 is pulled by the hand that grasps the handle 3, and the electric motor 10 stops when the pulling operation is released. When switched to the "pushbutton mode", the switch lever 32 is fixed in the ON position but the electric motor 10 is not yet energized; when the pushbutton 33 is pushed, the electric motor 10 is energized, the electric motor 10 starts up, and the electric motor 10 stops when the pushing operation is performed once more. Because there is no need to continuously pull the switch lever 32 in the "pushbutton mode", a continuous-chipping operation or the like can be performed comfortably.

A tool holder 11 for mounting a cutting tool (not shown), such as a drill bit, is disposed within the tip of the main-body part 2. The main-body part 2 comprises a motive-power output system that has two systems: a rotational-output system, which rotates the tool holder 11 around an axis J, and an impact-output system, which imparts an impact in the axial direction to the cutting tool mounted in the tool holder 11. In the rotational-output system, an output shaft 10*a* of the electric motor 10 is rotatably supported by bearings 6, 7. The bearing 6, which is on the motor-front-part side, is held inside a holding hole 28*c* of a gear housing 28 (refer to FIG. 4). An oil seal 36 for preventing leakage of lubricant is mounted on the bearing 6 on the front side in the motor-axis direction. The bearing 7, which is on the motor-rear-part side, is held by the main-body housing 4.

An intermediate gear 13, which includes a torque limiter, meshes with an output gear 10*aa* provided on the front portion of the output shaft 10*a*. The intermediate gear 13 is integrally provided with a first drive gear 12. The first drive gear 12 is rotatably supported by bearings 8, 9. The bearing 8, which is on the upper side, is held by a crank housing 22; the bearing 9, which is on the lower side, is held by the gear housing 28. The rotational output of the electric motor 10 is transmitted to the first drive gear 12 via the intermediate gear 13 that includes the torque limiter. The first drive gear 12 meshes with a first follower gear 14, which has a circular-cylindrical shape. The rear portion of the tool holder 11 meshes with the inner-circumference side of the first follower gear 14 via a spline-mating part 11*a*. The tool holder 11 rotates, integrally with the first follower gear 14, around the axis J via the spline-mating part 11*a*. The motive-power transmission system, which extends from the electric motor 10 to the tool holder 11 via the first drive gear 12 and the first follower gear 14, constitutes the rotational-output system.

The tool holder 11 is rotatably supported by an inner circumferential side of a barrel 24 via an oilless bearing 23. The oilless bearing 23 is fixed to the inner circumferential side of the barrel 24. The barrel 24 is fixed to a front housing 5. An oil seal 25 is mounted between the front portion of the inner circumferential side of the barrel 24 and an outer circumferential surface of the tool holder 11. A gap between the inner circumferential side of the barrel 24 and the outer circumferential surface of the tool holder 11 is sealed in an oil-tight manner (sealable with respect to oils and fats) by this oil seal 25. In addition, as will be described below, an oil-repellent coating is applied to a sliding-contact part of the outer circumferential surface of the tool holder 11 that slides with respect to the oilless bearing 23 and oil droplets of the lubricant are made, thereby also enhancing the sealing properties of the sliding-contact part. By enhancing the sealing properties of the sliding-contact part, the lubricant inside the crank housing 22 can be prevented from leaking out to the exterior of the barrel 24.

In the impact-output system, a second drive gear 15, in addition to the above-mentioned intermediate gear 13, meshes with the output gear 10*aa* of the electric motor 10. A crankshaft 16 is integrally provided with the second drive gear 15. The crankshaft 16 is rotatably supported by bearings 16*a*, 16*b*. The bearing 16*a*, which is on the upper side, is held by the crank housing 22; the bearing 16*b*, which is on the lower side, is held by the gear housing 28. A needle bearing is used in the bearing 16*b*, which is on the lower side. A piston 18 is connected to the tip of a connecting rod 17, which is coupled to the crankshaft 16. The piston 18 is provided so that it can reciprocally move in an airtight manner on an inner-circumference side of a cylinder 19. A front-part side of the cylinder 19 enters into the inner-circumference side of the tool holder 11. On the front side of the piston 18, a striker 20 is disposed within the cylinder 19.

Figure 2:
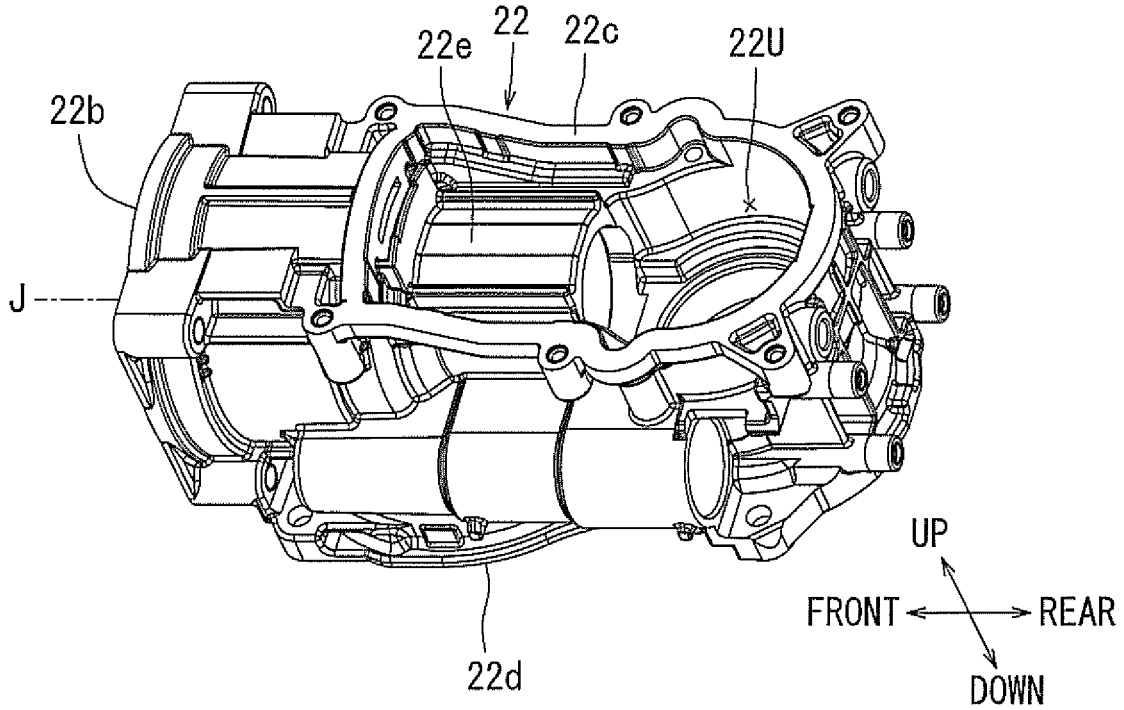
FIG. 2 is an oblique view of a crank housing. This figure shows the state in which it is viewed diagonally from above.
Figure 3:
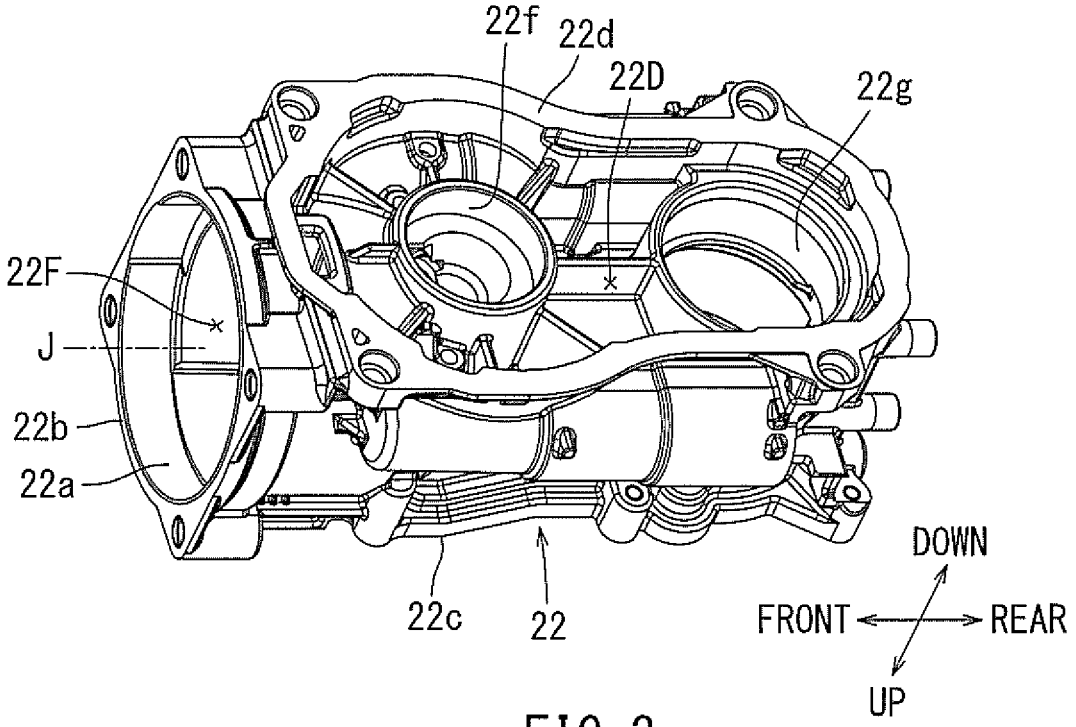
FIG. 3 is an oblique view of the crank housing. This figure shows the state in which it is viewed diagonally from below.

The cylinder 19 is inserted into a circular-cylinder-shaped support part 22*e*, which is integrally provided with the crank housing 22, and is thereby supported. As shown in FIG. 2 and FIG. 3, the crank housing 22 is a cast article, and the support part 22*e* for holding the cylinder 19 is integrally provided at substantially the center of the crank housing 22. In addition, the crank housing 22 has an opening 22F on a front part side, an opening 22U on an upper-part side, and an opening 22D on a lower-part side. The barrel 24 is joined to the opening 22F on the front-part side of the crank housing 22 in an oil tight manner. The crank housing 22 and the barrel 24 are fixed with respect to the main-body housing 4 and the front housing 5. The opening 22U on the upper-part side of the crank housing 22 is closed up by a crank cap 27 in an oil tight manner. The above-mentioned mode-changing lever 35 is attached to the crank cap 27. The mode-changing lever 35 is attached to the crank cap 27 via an O-ring 34 in an oil tight manner.

Figure 4:
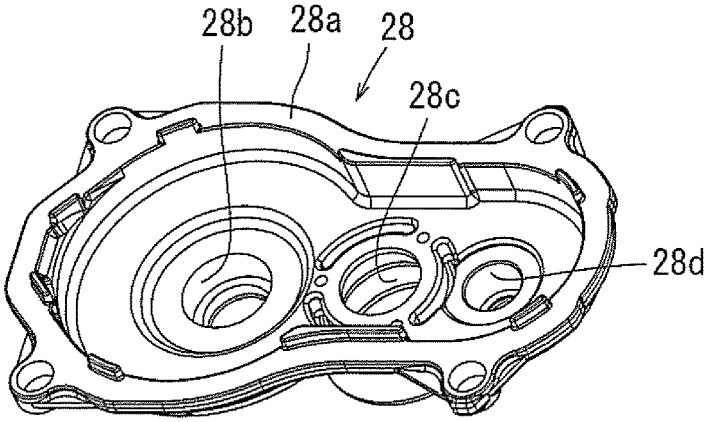
FIG. 4 is an oblique view of a gear housing. This figure shows the state in which it is viewed diagonally from above.

The opening 22D on the lower-part side of the crank housing 22 is closed up by the gear housing 28 in an oil tight manner. As shown in FIG. 3, two holding holes 22*f*, 22*g* are provided on the lower-part side of the crank housing 22. The upper-side bearing 8, which rotationally supports the first drive gear 12, is held by the holding hole 22*f*, which is on the front side. The bearing 16*a*, which rotationally holds the crankshaft 16, is held by the holding hole 22*g*, which is on the rear side. In addition, as shown in FIG. 4, the gear housing 28 is provided with three holding holes 28*b*, 28*c*, 28*d*. The bearing 9, which is on the lower side and rotationally supports the first drive gear 12, is held by the holding hole 28*b*, which is on the front side. The bearing 6, which is on the upper side and rotationally supports the output shaft 10*a* of the electric motor 10, is held by the holding hole 28*c*, which is at the center. The holding hole 28*c* passes through in the plate-thickness direction. The bearing 16*b*, which is on the lower side and rotationally supports the crankshaft 16, is held by the holding hole 28*d*, which is on the rear side.

A fluorine-based coating (an oil-repellent coating) is applied to each of an inner circumferential surface of the center holding hole 28*c* and an outer circumferential surface of an outer ring of the bearing 9. By applying the oil-repellent coating to the inner circumferential surface of the holding hole 28*c* and to a contact surface (junction) of the bearing 9 that contacts that inner circumferential surface, leakage of the lubricant is prevented. The portion(s), at which the oil-repellent coating is applied to the bearing 9, is (are) not limited to the outer circumferential surface of the outer ring, and the sealing properties inside the crank housing 22 can be greatly enhanced by applying the oil-repellent coating to the inner circumferential surface of the inner ring or to the entirety thereof. Furthermore, in the bearing 9, the sealing properties of the bearing 9 itself can be enhanced by applying the oil-repellent coating to the sealing element(s), which is (are) mounted on both side surfaces, in order to enhance the sealing properties between the inner ring and the outer ring; consequently, leakage of the lubricant inside the crank housing 22 can be prevented much more reliably.

An impact bolt 21 is supported on the inner-circumference side of the tool holder 11 so as to be displaceable in the axis J direction. The rear portion of the impact bolt 21 enters into the cylinder 19. On the front side of the impact bolt 21, the cutting tool is mounted in the inner-circumference side of the tool holder 11. By reciprocally moving the piston 18 inside the cylinder 19 and by the striker 20 striking against the rear-end surface of the impact bolt 21, impacts are applied to the cutting tool in the axis J direction. The motive-power transmission system, which extends from the electric motor 10 via the second drive gear 15, the crankshaft 16, the connecting rod 17, the piston 18 and the striker 20 to the impact bolt 21, constitutes the impact-output system.

Thus, the barrel 24, the crank cap 27 and the gear housing 28 (components supported by the housing) are joined to the crank housing 22, and the rotational-output system and the impact-output system are housed in the space formed thereby. Lubricant (grease) is coated on the output gear 10*aa* of the electric motor 10, the intermediate gear 13, the first drive gear 12, the first follower gear 14, the tool holder 11, the spline-mating part 11*a*, and the second drive gear 15, which constitute the rotational-output system and the impact-output system. In order to prevent lubricant leakage to the outside of the above-mentioned space of the lubricant-coated parts of each of these locations, various lubricant leakage countermeasures are applied. In the present embodiment, the below-described leakage countermeasures are applied in addition to or instead of sealing elements, such as ordinary oil seals, O-rings, and seal rings.

Figure 5:
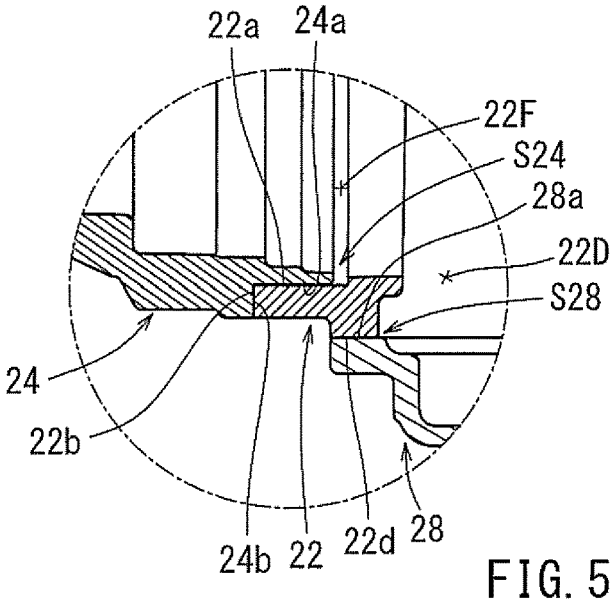
FIG. 5 is an enlarged view of section (V) in FIG. 1. This figure shows a detail of junctions that join a barrel and the gear housing to the crank housing.
Figure 6:
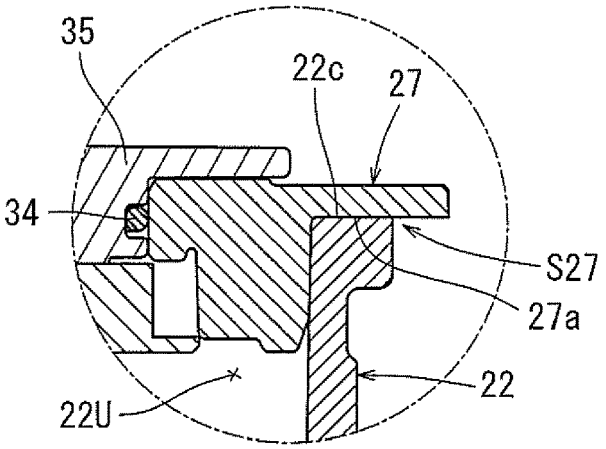
FIG. 6 is an enlarged view of section (VI) in FIG. 1. This figure shows a detail of a junction that joins a crank cap to the crank housing.

As described above, the barrel 24 is joined to the opening 22F on the front-part side of the crank housing 22 in an oil-tight manner, the crank cap 27 is joined to the opening 22U on the upper-part side in an oil-tight manner, and the gear housing 28 is joined to the opening 22D on the lower-part side in an oil-tight manner. FIG. 5 and FIG. 6 show the details of: a junction S24, which joins the barrel 24 to the opening 22F on the front-part side of the crank housing 22; a junction S27, which joins the crank cap 27 to the opening 22U on the upper-part side; and a junction S28, which joins the gear housing 28 to the opening 22D on the lower-part side.

As shown in FIG. 5, in the junction S24, which joins the barrel 24 to the opening 22F on the front-part side of the crank housing 22, the oil-repellent coating is applied to joining surfaces 24*a*, 24*b* of the barrel 24 and to joining surfaces 22*a*, 22*b* of the crank housing 22, which are opposed to the joining surfaces 24*a*, 24*b*. In addition, as shown in FIG. 6, in the junction S27, which joins the crank cap 27 to the opening 22U on the upper-part side of the crank housing 22, the oil-repellent coating is applied to a joining surface 27*a* of the crank cap 27 and to a joining surface 22*c* of the crank housing 22, which opposes the joining surface 27*a*. Furthermore, in the junction S28, which joins the gear housing 28 to the opening 22D on the lower-part side of the crank housing 22, the oil-repellent coating is applied to a joining surface 28*a* of the gear housing 28 and to a joining surface 22*d* of the crank housing 22, which opposes the joining surface 28*a*. The oil-repellent coating is applied over the entire circumference of each of the joining surfaces 22*a*, 22*b*, 22*c*, 22*d*, 24*a*, 24*b*, 27*a*, 28*a*.

In the present embodiment, a fluorine-based coating is applied as one example of an oil-repellent coating. Oil repellency is imparted to each of the joining surfaces 22*a*, 22*b*, 22*c*, 22*d*, 24*a*, 24*b*, 27*a*, 28*a* by applying the fluorine-based coating. Owing to this oil repellency, the lubricant, such as grease, is caused to form droplets (oil repellent). Generally speaking, the contact angle of the oil with respect to parts not subjected to the oil-repelling treatment is approximately 20°; in contrast, in this specification, the state that results when the contact angle is approximately 30° or greater is called oil dropletization. By virtue of the joining surfaces 24*a*, 24*b* of the barrel 24 being respectively joined to the joining surfaces 22*a*, 22*b* of the crank housing 22, each of which has had a fluorine-based coating applied thereto, in the state in which they are opposed to one another, the barrel 24 is joined to the opening 22F on the front-part side of the crank housing 22 in an oil-tight manner. Likewise, by virtue of the joining surface 27*a* of the crank cap 27 being joined to the joining surface 22*c* of the crank housing 22 in the state in which they are opposed to one another, the crank cap 27 is joined to the opening 22U on the upper-part side of the crank housing 22 in an oil-tight manner. In addition, by virtue of the joining surface 28*a* of the gear housing 28 being joined to the joining surface 22*d* of the crank housing 22 in the state in which they are opposed to one another, the gear housing 28 is joined to the opening 22D on the lower-part side of the crank housing 22 in an oil-tight manner.

The spaces between the joining surface 22*a* and the joining surface 24*a*, between the joining surface 22*c* and the joining surface 27*a*, and between the joining surface 22*d* and the joining surface 28*a* are locations at which seal rings have been interposed in the past; however, in the present embodiment, a lubricant leakage prevention countermeasure is applied by applying an oil-repellent coating instead of an O-ring. By applying a fluorine-based coating to each of the joining surfaces 22*a*, 22*b*, 24*a*, 24*b*, the joining surfaces 22*c*, 27*a*, and the joining surfaces 22*d*, 28*a*, lubricant that flows from the lubricant-coated parts is caused to form droplets, and thereby leakage to the exterior by penetrating into the small gaps between the junctions S24, S27, S28 is prevented.

According to the lubricant leakage prevention countermeasure of the present embodiment as explained above, by applying the fluorine-based coating to each of the joining surfaces 22*a*, 22*b*, 24*a*, 24*b*, at which the barrel 24 is joined to the crank housing 22, the joining surfaces 22*c*, 27*a*, at which the crank cap 27 is joined to the crank housing 22, and the joining surfaces 22*d*, 28*a*, at which the gear housing 28 is joined to the crank housing 22, leakage of lubricant, which is coated principally on the gear-meshing parts, can be prevented. Because the present embodiment has a configuration in which the lubricant is caused to form droplets by the fluorine-based coating and the lubricant is prevented from bleeding out through small gaps, it is possible to prevent leakage of much more of the lubricant as compared to a configuration in which leakage is prevented by interrupting capillary action as in the past; thereby, the sealing properties of the lubricant-coated parts can be enhanced much more.

In addition, because the sealing properties of the lubricant-coated parts can be ensured without separately using a sealing element, such as an O-ring, the cost of the power tool can be reduced and assembly can be simplified by omitting the sealing element.

In the embodiment as explained above, a configuration was exemplified in which a fluorine-based coating was applied to both joining surfaces that oppose one another; however, the same functions and effects can be obtained even in the case of a configuration in which a fluorine-based coating is applied to only one of the opposing joining surfaces.

In addition, in the exemplified embodiment, a configuration (an oil-repelling treatment) was exemplified in which oil repellency is imparted by applying a fluorine-based coating to the joining surfaces; however, they may also be configured to impart oil repellency by applying a so-called nanocoating (a surface treatment in which unevenness is provided at the nano level) instead of a fluorine-based coating. In addition to or instead of the joining surfaces, the range, over which the oil repellency is imparted, may include the inner circumferential surfaces of the crank housing, the barrel, the crank cap, and the gear housing, which are on the upstream side of the joining surfaces in the lubricant flow direction.

Furthermore, configurations have been exemplified in which a surface treatment, such as a fluorine-based coating, a nanocoating, or the like, is applied the joining surfaces 22*a*, 24*a*, 22*b*, 24*b* and to the joining surfaces 22*c*, 27*a*, 22*d*, 28*a*; however, the junctions can be imparted with oil repellency also by forming the crank housing 22 itself or the barrel, the crank cap, and the gear housings themselves of a material (metal, resin) exhibiting oil repellency. In addition, it may have a configuration in which oil repellency is imparted by attaching, to the junctions, structures manufactured from a material exhibiting oil repellency.

Furthermore, configurations have been exemplified in which the oil-repelling treatment was applied to the junctions that join the barrel 24, the crank cap 27, and the gear housing 28 to the crank housing 22, and the junction that joins the bearing 6 to the holding hole 28*c* of the gear housing 28 (the inner circumferential surface of the holding hole 28*c* and the outer circumferential surface of the outer ring of the bearing 6); however, instead of or in addition to such, it may be configured such that the oil-repellent coating is applied to the inner circumferential surface of the inner ring of the bearing 6 and to a lip part (inner-circumference side) of the oil seal 36. Furthermore, the sealing properties can be enhanced much more by applying the oil-repellent coating to the area contacted by the inner circumferential surface of the inner ring of the bearing 6, which is the outer circumferential surface of the output shaft 10*a* rotatably supported by the gear housing 28 via the bearing 6, or to the area slidably contacted by the lip part of the oil seal 36 and furthermore to the peripheral area of these areas on the front side in the motor-axis direction. In addition, the oil-repellent coating can also be applied to the bearing 6 and to both side surfaces of the oil seal 36 (both end surfaces in the motor-axis direction).

Furthermore, for example, by imparting oil repellency to a sliding-contact part S23 of the tool holder 11 that slidably contacts the oilless bearing 23, egress of the lubricant at the sliding-contact part S23 can be prevented. As shown in FIG. 1, a known O-ring is omitted between the oilless bearing 23 and the tool holder 11. In the case of the present embodiment, a fluorine-based coating is applied to the inner circumferential surface of the oilless bearing 23. In addition, a fluorine-based coating is also applied to the sliding-contact surface, which is the tip-side outer circumferential surface of the tool holder 11, that slidably contacts the oilless bearing 23 and also to the area on the rear side (the leakage-direction upstream side) thereof in the axial direction. Not being limited to the junctions S24, S27, S28 of the housing that houses the lubricant-coated parts, such as the gear-meshing parts or the like, leakage of the lubricant, which is coated on the lubricant-coated parts, to the exterior can be prevented more reliably by also applying the oil-repelling treatment with respect to the above-mentioned sliding-contact part S23.

In addition, in the exemplified embodiment, a configuration was exemplified in which, at the attachment location of the mode-changing lever 35 with respect to the crank cap 27, lubricant leakage of the lubricant-coated parts is prevented by using the O-ring 34; however, it can be configured to prevent leakage of the lubricant by omitting, at this location as well, the O-ring 34 and the groove for mounting the O-ring 34, and by applying the exemplified oil-repelling treatment to one or both joining surfaces on the crank cap 27 side and the mode-changing lever 35 side.

In the embodiment explained above, a configuration was exemplified in which a sealing element, such as a known O-ring, is omitted, and the oil-repelling treatment is applied instead; however, the present invention does not exclude the use of a sealing element in combination. By using the exemplified oil-repelling treatment in addition to a known sealing element, leakage of the lubricant can be prevented much more reliably.

In addition, although a hammer drill was exemplified as the power tool, the lubricant leakage prevention countermeasures can be applied to the gear chambers principally of electric-power tools, such as a screw-driving tools or cutting tools, or of power tools such as tillers or lawn mowers. Furthermore, the exemplified oil-repelling treatment can also be applied to enhance the sealing properties (oil tightness) of, for example, the air chamber of air compressors or the like.

The invention claimed is:

1. A power tool comprising:

an outer housing, a first inner housing inside the outer housing, the first inner housing having an interior and an opening into the interior and a lubricated movable part in the interior;

a component configured to form a seal with the first inner housing at a joint formed by a first portion of the first inner housing and a first portion of the component; and an oil-repellant coating on the first portion of the first inner housing and/or on the first portion of the component.

2. The power tool according to claim 1, wherein the first portion of the first inner housing is parallel to and pressed against the first portion of the component.

3. The power tool according to claim 2, wherein the oil-repellant coating comprises a fluorine-based coating.

4. The power tool according to claim 2, wherein the oil-repellant coating comprises a nanocoating.

5. The power tool according to claim 1, wherein:

the first portion of the first inner housing includes a cylindrical opening, the first portion of the component is cylindrical and extends into the cylindrical opening and a second portion of the component projects out of the cylindrical opening away from the first inner housing.

6. The power tool according to claim 5, wherein:

the first portion of the first inner housing includes an annular surface surrounding the cylindrical opening, the component includes an annular surface extending away from the first portion of the component and the annular surface of the first inner housing contacts the annular surface of the component.

7. The power tool according to claim 6, wherein the component is a second inner housing.

8. The power tool according to claim 5, wherein the oil-repellant coating comprises a fluorine-based coating.

9. The power tool according to claim 5, wherein the oil-repellant coating comprises a nanocoating.

10. The power tool according to claim 1, wherein the component is a second inner housing.

11. The power tool according to claim 1, wherein the oil-repellant coating comprises a fluorine-based coating.

12. The power tool according to claim 1, wherein the oil-repellant coating comprises a nanocoating.

13. The power tool according to claim 1, wherein the power tool is a hammer drill.

14. A power tool comprising:

an outer housing, a first inner housing inside the outer housing, the first inner housing having an interior and a first opening into the interior, and a second opening into the interior and a lubricated movable part in the interior, the first opening having a first peripheral portion lying at least partly in a plane and the second opening comprising a cylindrical inner wall;

a component connected to the first inner housing at a first joint formed by the first peripheral portion of the first opening and a first portion of the component;

a second inner housing having a cylindrical outer wall and being connected to the first inner housing at a second joint formed by the cylindrical outer wall and the cylindrical inner wall; and an oil-repellant coating on at least one structure selected from the group consisting of the first peripheral portion of the first inner housing, the first portion of the component, the cylindrical outer wall and the cylindrical inner wall.

15. The power tool according to claim 14, wherein the component is a third inner housing.

16. The power tool according to claim 15, wherein the oil-repellant coating comprises a fluorine-based coating.

17. The power tool according to claim 15, wherein the oil-repellant coating comprises a nanocoating.

* * * * *